United States Patent [19]

Yotsuya et al.

[11] Patent Number: 4,791,425

[45] Date of Patent: Dec. 13, 1988

[54] WINDOW ANTENNA FOR A VEHICLE

[75] Inventors: Hiroshi Yotsuya; Hiroshi Kondo, both of Toyota; Kaoru Sakurai, Kawasaki; Harunori Murakami, Machida; Hajime Murakami, Yokohama, all of Japan

[73] Assignees: Toyota Jidosha Kaisha; Nippon Sheet Glass Co., Ltd., both of Japan

[21] Appl. No.: 863,921

[22] Filed: May 15, 1986

[30] Foreign Application Priority Data

May 20, 1985 [JP] Japan ..... 60-107981

[51] Int. Cl.[4] ..... H01Q 1/32

[52] U.S. Cl. ..... 343/713

[58] Field of Search ..... 343/704, 711, 712, 713

[56] References Cited

U.S. PATENT DOCUMENTS 4,063,247 12/1977 Sakurai et al. ..... 343/713

4,608,570 8/1986 Inaba et al. ..... 343/704

*Primary Examiner*—William L. Sikes

*Assistant Examiner*—Doris J. Johnson

*Attorney, Agent, or Firm*—Jones, Day, Reavis & Pogue

[57] ABSTRACT

An antenna element is mounted on a glass of a rear quarter window of a vehicle along the edge thereof. A coupling element is provided midway along said antenna element for coupling between two segmented elements with phase adjustment between reception signals thereof in a specific frequency range. The coupling element connects the two segmented elements in lower frequency range, and disconnects the two elements in higher frequency range. The length of the antenna element is automatically corrected in respective low and high frequency ranges so as to cover a wide range.

9 Claims, 7 Drawing Sheets

MEAN 38.1 dBμ
MIN 31.8 dBμ (282°)
MAX 39.2 dBμ
DIR. 6.3 dBμ

MEAN 37.5 dBμ
MIN 30.8 dBμ (83°)
MAX 41.4 dBμ
DIR. 6.7 dBμ

MEAN 35.0 dBμ
MIN 29.3 dBμ (65°)
MAX 38.3 dBμ
DIR. 5.7 dBμ

MEAN 41.9 dBμ
MIN 34.5 dBμ (58°)
MAX 48.5 dBμ
DIR. 7.4 dBμ

MEAN 42.2 dBμ
MIN 35.4 dBμ (353°)
MAX 48.1 dBμ
DIR. 6.8 dBμ

MEAN 41.3 dBμ
MIN 34.1 dBμ (176°)
MAX 45.5 dBμ
DIR. 7.2 dBμ

MEAN 27.4 dBμ
MIN 16.1 dBμ (122°)
MAX 32.3 dBμ
DIR. 11.3 dBμ

MEAN 31.7 dBμ
MIN 18.8 dBμ (67°)
MAX 38.1 dBμ
DIR. 12.9 dBμ

MEAN 23.5 dBμ
MIN 10.6 dBμ (11°)
MAX 29.4 dBμ
DIR. 12.9 dBμ

WINDOW ANTENNA FOR A VEHICLE

BACKGROUND OF THE INVENTION

1. Field of the Invention

The present invention relates o a window antenna for a vehicle and, more particularly, to a window antenna which can reliably receive a TV broadcast wave.

2. Description of the Prior Art

As is conventionally known, a radio-reception antenna wire can be provided on a surface on the passenger compartment side of the rear windshield of a vehicle, in addition to a plurality of defogging heater wires. Such an antenna wire is normally tuned to sensitively receive a radio broadcast signal in the AM and FM bands, but cannot receive a TV broadcast signal. Therefore, in order to receive both radio and TV broadcast signals in the vehicle compartment, a special-purpose antenna for receiving a TV broadcast signal must be additionally provided.

It is generally difficult to mount a broad-band Yagi antenna for receiving a TV broadcast signal on a vehicle. Therefore, a TV antenna wire must be arranged on a surface of the vehicle, as in the case of an AM/FM window antenna. However, since the vehicle body is formed mainly of an iron plate and the rear windshield is occupied by the radio antenna wire, possible mounting areas for the TV antenna are limited. It is undesirable to mount the antenna wire on the front windshield, with regard to the field of view.

Even if the TV antenna can be mounted, a TV broadcasting frequency extends over a wide range, for example in Japan, from a low frequency range (90 to 108 MHz of channel Nos. 1 to 3) to a high frequency range (170 to 222 MHz of channel Nos. 4 to 12). Therefore, it is very difficult to cover such a broad bandwidth as well as a UHF band with a single antenna.

SUMMARY OF THE INVENTION

The present invention has been made in consideration of the above situation, and has as its object to provide a window antenna which effectively utilizes a limited antenna mounting area, and which can reliably receive a TV broadcast signal.

A window antenna for a vehicle according to the present invention is characterized by including an antenna wire, having a coupling wire (folded portion) for coupling antenna elements, provided along edges of a window glass mounted in a rear quarter window frame, so as to adjust phases of the antenna elements in a specific frequency range.

In a window antenna for a vehicle according to a preferred aspect of the present invention, an antenna wire having a pair of antenna elements provided along different edges of a window glass, a coupling wire which couples the respective elements so that their phases are adjusted in a specific frequency range, and a feed point provided at an end of one antenna element is provided on the window glass.

According to another preferred aspect of the present invention, the window antenna is provided on rear quarter windows on both sides of the vehicle.

For a low TV broadcasting band, a sum of the two antenna elements serves as an effective antenna length, and for a high TV broadcasting band, the coupling wire loses its phase adjustment function and serves to isolate the elements, so that the one antenna element connected to the feed point is enabled.

These and other objects and many of the attendant advantages of this invention will be readily appreciated as the same becomes better understood by reference to the following detailed description when considered in connection with the accompanying drawings.

DETAILED DESCRIPTION OF THE PREFERRED EMBODIMENT

Figure 1:
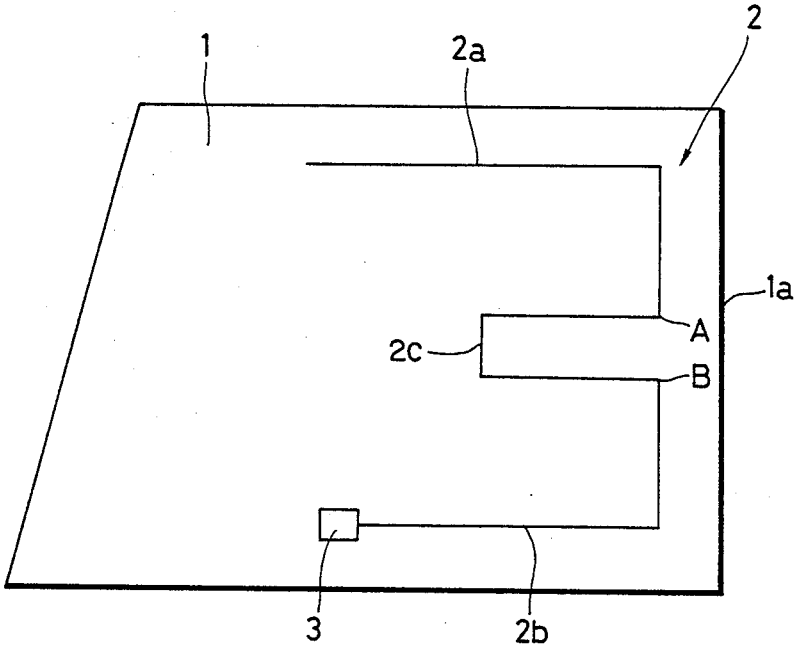
FIGS. 1 to 5 show patterns of an antenna wire provided on a rear side window of a vehicle according to an embodiment of the present invention.

FIGS. 1 to 6 show an embodiment of the present invention, in which a TV antenna wire 2 is provided on a window glass (rear quarter window) 1, which is mounted in a rear quarter window frame portion of a vehicle, by printing and baking a conductive paste material thereon. The rear quarter window 1 may be of a fitted type, or a pivoted vent or a slidable vent. The antenna wire 2 is provided on one or both rear side windows 1. When two antenna wires 2 are symmetrically provided on two side window glasses 1, they are combined in a diversity reception system which selects the reception signal having the higher reception level between the signals from the two antenna wires 2.

Figure 7:
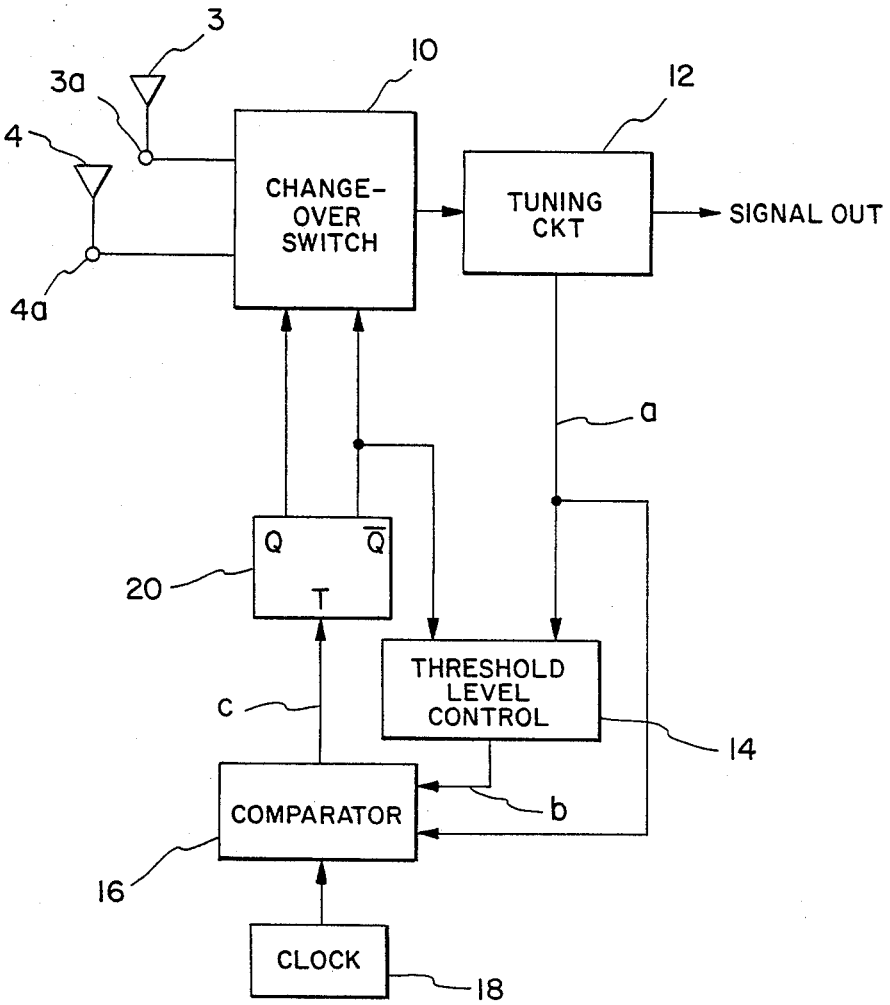
FIG. 7 PRIOR ART
FIG. 7 shows the details of a diversity reception system.

In the operation of the well-known diversity reception system, shown in FIG. 7, the reception signals obtained at feed points 3*a*, 4*a* are fed to a changeover switch through preamplifiers (not shown). A selected reception signal, e.g. at 3*a*, is then supplied ot a tuning circuit 12 which includes a front-end unit, an IF circuit, a detector circuit etc. The tuning circuit 12 outputs a detection signal to a next stage such as a video amplifier and a color decoder.

The tuning circuit 12 includes a level detector for detecting a level or an amplitude of the reception signal and outputs a level detection signal a to a threshold level controller 14. The threshold level control sets and holds a threshold level b for discriminating a decrease or increase of the level detection signal a. The level detection signal a and threshold level b are fed to a comparator 16 to be compared therein.

When the level detection signal a decreases below the threshold level b, a change-over signal c is generated in synchronism with a clock pulse e.g. 100 KHz supplied by a clock pulse circuit 18. The change-over signal c is fed to a trigger terminal of a steering flip-flop 20 to switch over. The switched Q and Q outputs of the flip-flop 20 are supplied to change-over switch 10 to change over the reception signal at the feed point 3*a* to a signal at the feed point 4*a*. Then, the reception signal from the antenna 4 having a higher level than the former is processed by the tuning circuit 12 and the signal level thereof is now discriminated at the comparator 16.

The Q output of the flip-flop 20 is supplied to a threshold level controller 14 to modify automatically the threshold level b in accordance with a change-over frequency. The threshold b is finely modified either downwardly or upwardly so as to increase the change-over frequency. Thus, the threshold level is finely adjusted just on the generally crossing level of two reception signal form the feed points 3*a* and 4*a*. At the crossing level of two reception signals, the change-over occurs most frequently.

Figure 2:
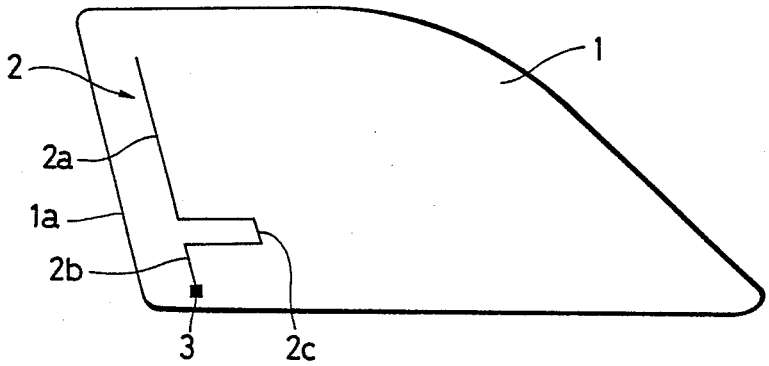
Figure 3:
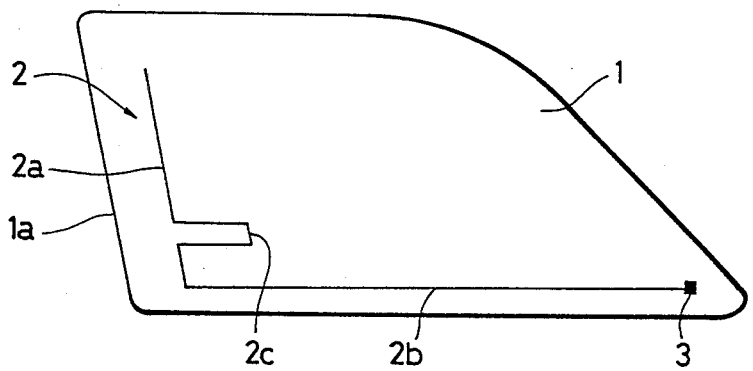
Figure 4:
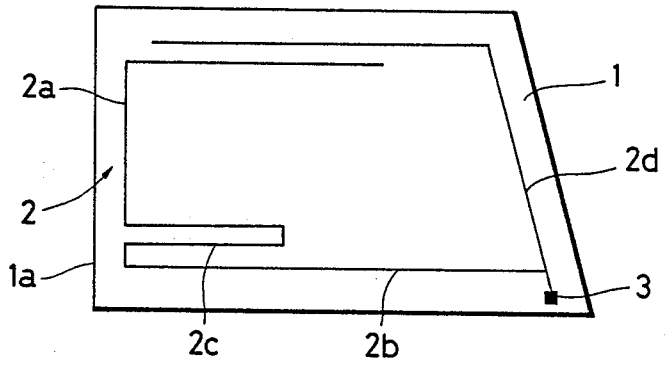

The antenna wire 2 consists of a pair of antenna elements 2*a* and 2*b*, which are provided along an edge 1*a* of the window glass 1 and are connected through a U-shaped coupling wire (folded wire) 2*c*. The elements 2*a* and 2*b* can be constituted by a combination of two L-shaped (vertical and horizontal) segments, as shown in FIG. 1; alternatively by a combination of only vertical segments, as shown in FIG. 2; by a combination of an L-shaped and a vertical segment, as shown in FIG. 3; or by a combination of L-shaped segments and another auxiliary antenna element 2*d*, as shown in FIG. 4. The antenna elements 2*a* and 2*b* can be either symmetrical or asymmetrical. A feed point 3 is provided for one antenna element, e.g., at one end of one of the antenna elements 2*a* and 2*b*.

The coupling wire 2*c* is tuned so that of reception signals of the antenna elements 2*a* and 2*b* are matched and the signals are added. In a low frequency range (e.g., TV channel Nos. 1 to 3), the elements 2*a* and 2*b* serve as a single antenna, and a good reception output can be obtained. An effective antenna length at this time corresponds to a sum of the lengths of the elements 2*a* and 2*b*, i.e., 500–600 mm, excluding that of the coupling wire 2*c*. In other words, terminals A and B of the elements 2*a* and 2*b*, respectively, are substantially short-circuited when tuned.

In a high frequency range (i.e., TV channel Nos. 4 to 12), the terminal B of the element 2*b* connected to the feed point 3 serves as a reflection point of a standing wave, and an impedance after the terminal B (on the element 2*a* side) is much increased, thus providing reception characteristics which are shifted to a short wavelength, as if the element 2*a* was disconnected. The effective antenna length at that time corresponds to the length of the element 2*b* (i.e., 250 to 300 mm), and a high gain can be obtained in the high frequency range.

In this way, good reception characteristics can be obtained over all the VHF TV broadcasting bands. When the window antenna of the present invention is provided on both rear side windows of a vehicle, a variation in reception level corresponding to a change in vehicle running direction can be stabilized by the diversity reception system using the two antennas.

Alternatively, the length adjustment of the elements 2*a* and 2*b*, and tuning of the coupling wire 2*c* can be performed so that the VHF band is received by the sum of the elements 2*a* and 2*b*, and the UHF band is received only by the element 2*b*.

The coupling wire 2*c* can be folded several times in order to obtain a predetermined length within a limited area, and can be an arc (ellipse) or a part of a secondary curve connecting the terminals A and B. Alternatively, the wire 2*c* can be replaced with a choke coil exhibiting a high impedance in the high frequency range.

Figure 5:
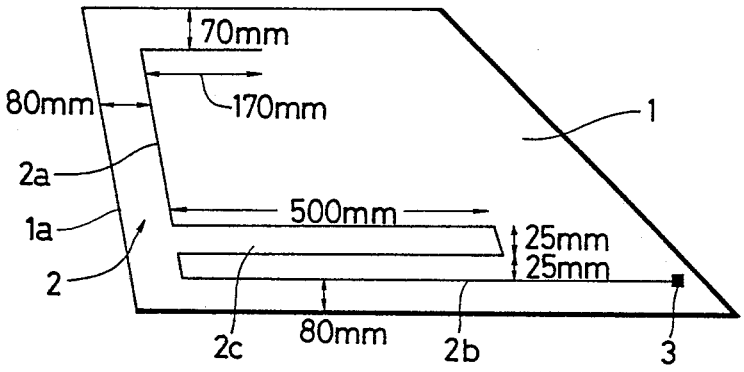
Figure 6A:
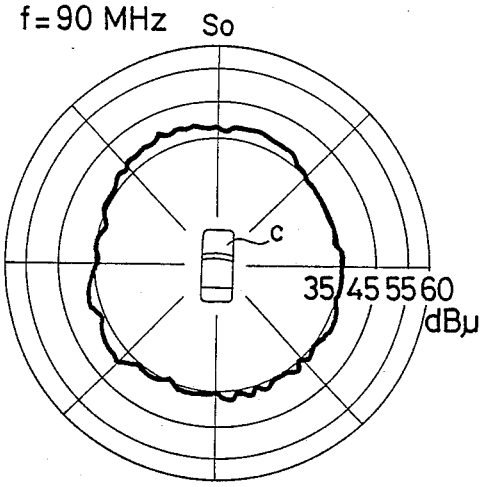
FIGS. 6A to 6I are directivity diagrams of the window antenna according to the embodiment of the present invention.
Figure 6B:
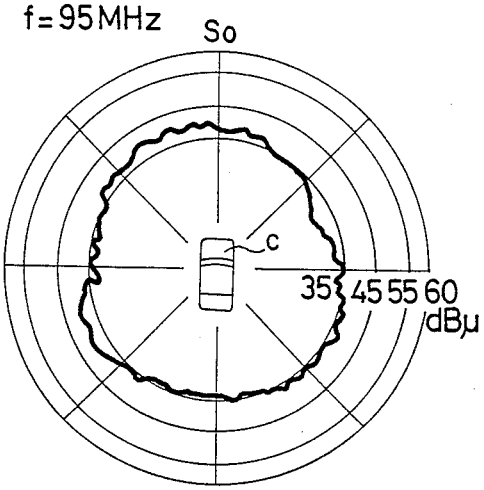
Figure 6C:
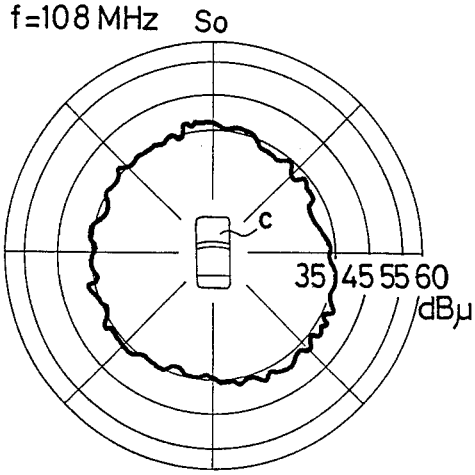
Figure 6D:
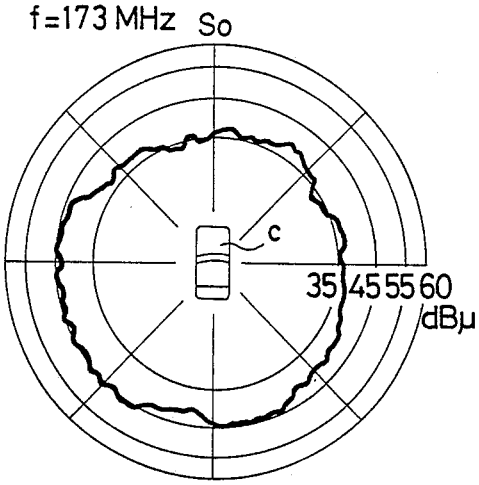
Figure 6E:
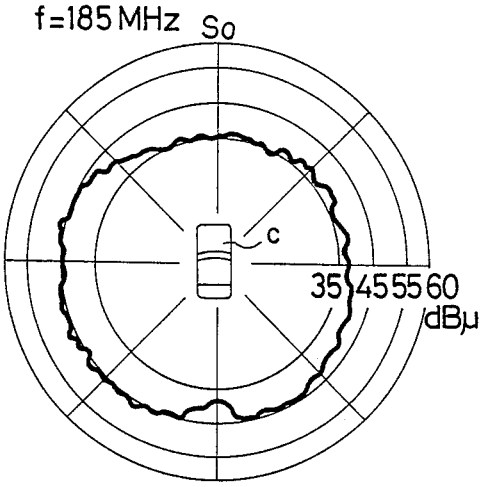
Figure 6F:
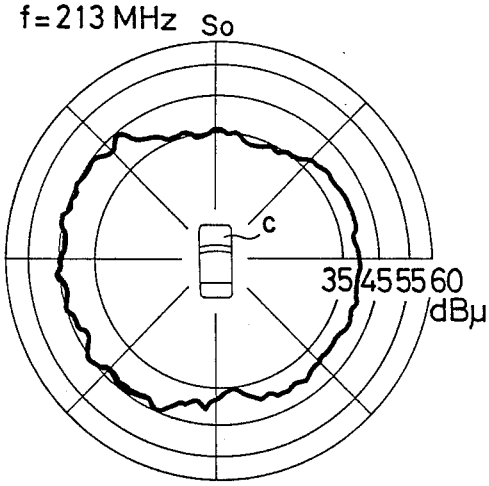
Figure 6G:
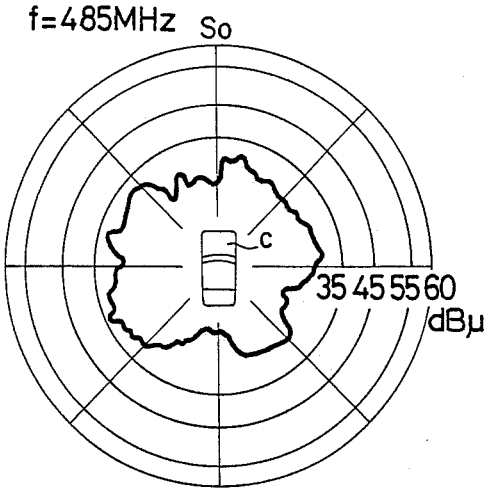
Figure 6H:
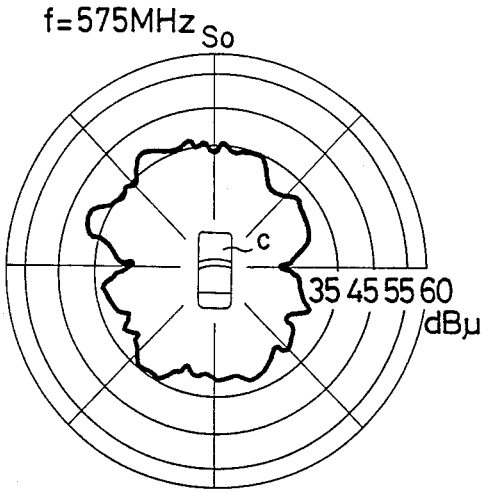
Figure 6I:
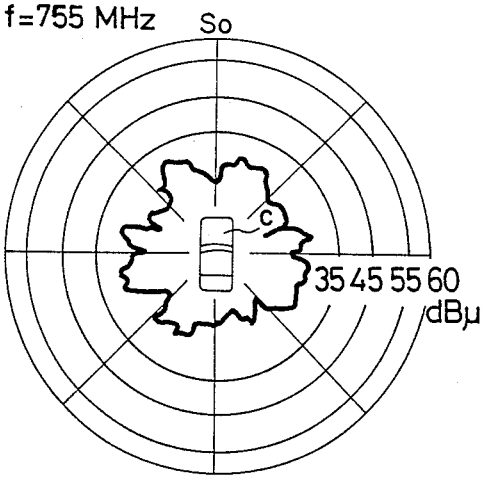

A window antenna of the pattern shown in FIG. 5 was arranged on a fixed rear quarter window on the driver's side of a vehicle, and directivities of this antenna in various frequency ranges were examined, obtaining the results shown in FIGS. 6A to 6I.

In each directivity diagram, a vehicle C, on which the window antenna was mounted, was rotated through 360° with respect to a reference position S0, and a TV broadcast signal (a horizontally polarized wave) was transmitted thereto from the direction of the reference position S0 in a uniform electric field of 60 dBμ, so as to plot reception sensitivity levels (in units of: dBμ) corresponding to respective positions of the vehicle C. Each directivity diagram represents a mean reception sensitivity level (MEAN), a minimum reception sensitivity level (MIN), a maximum reception sensitivity level (MAX), and a directivity (DIR.=(MEAN)−(MIN)).

As can be easily understood from the directivity diagrams, in the TV broadcast signal range of 90 to 755 MHz, a virtually satisfactory reception sensitivity can be obtained, and the directivities are relatively small (5.0 dBμ to 12.9 dBμ). Therefore, the window antenna of this embodiment serves as a non-directivity antenna having a relatively stable reception sensitivity. Note that if an amplifier is added, the reception sensitivity can be increased to a given level.

Since the window antenna of the present invention has the characteristics described above, it can be provided in one or both rear quarter windows of a vehicle. When the window antenna of the present invention is provided in both the rear quarter windows, they can be individually used as antennas for the diversity reception system. Alternatively, when the window antenna of the present invention is provided in one rear quarter window and an antenna having another pattern is provided in the other rear quarter window, they can also constitute the diversity reception system. Moreover, when the window antenna of the present invention is provided in one rear quarter window, it can be combined with at least one other antenna provided on another portion of the vehicle, such as a rear-rod antenna, a front-rod antenna, a rear-whip antenna, and a front-whip antenna, so as to constitute the diversity reception system.

A window glass with an antenna of the present invention can be fitted in a rear quarter window frame, or can be mounted thereon to be open or closed horizontally or vertically by means of a hinge, or can be slidably mounted thereon.

According to the present invention as described above, in the low frequency range, a sum of the lengths of a pair of antenna elements 2*a* and 2*b* can be an effective antenna length through a phase adjustment function of the coupling wire 2*c*, and in the high frequency range, the coupling wire 2*c* loses its phase adjustment function and only the element 2*b* connected to the feed point 3 is enabled. Therefore, good reception characteristics over a wide range, from low to high frequencies, can be obtained and, more specifically, a TV broadcast signal can be received in the compartment of a vehicle.

What is claimed is:

1. A window antenna mounted on a glass of a rear quarter window of a vehicle, comprising an L-shaped antenna consisting of a horizontal element and a vertical element provided along two adjacent edges of the window glass, and a coupling element provided midway along said antenna for coupling said horizontal and vertical antenna elements with phase adjustment between reception signals thereof in a specific frequency range, and a feed point connected to an open end of one of said antenna elements.

2. A window antenna according to claim 1, wherein said two antenna elements and said coupling wire are arranged on two rear quarter windows of the vehicle.

3. A window antenna according to claim 1, wherein said coupling elemen comprises U-shaped wire.

4. A window antenna according to claims 1 or 3, wherein said antenna comprises a U-shaped wire provided along upper and lower edges and a vertical edge of the window glass, and said coupling element is provided to a vertical section of the antenna element to divide it into two L-shaped upper and lower segments and to connect therebetween.

5. A window antenna according to claim 2, wherein said antennas on both sides of the rear quarter window are incorporated in a diversity reception system.

6. A window antenna according to claim 1, wherein said coupling element is provided to a vertical section of the L-shaped antenna.

7. A window antenna according to claim 4, wherein said coupling element is provided at a corner portion of said L-shaped upper and lower segments.

8. A window antenna according to claim 1, further comprising an auxiliary antenna element connected to one of said horizontal or vertical antenna elements.

9. A window antenna according to claim 8, wherein said auxiliary antenna element has a distal end portion extending closely along the other of said horizontal or vertical antenna elements at a distance so as to electrically couple thereto.

* * * * *